US006534454B1

(12) United States Patent
Garmier et al.

(10) Patent No.: US 6,534,454 B1
(45) Date of Patent: Mar. 18, 2003

(54) BIODEGRADABLE VEGETABLE OIL COMPOSITIONS

(75) Inventors: William W. Garmier, Hartville, OH (US); Adam W. Rotondo, Hartville, OH (US)

(73) Assignee: Renewable Lubricants, Inc., Hartville, OH (US)

( * ) Notice: Subject to any disclaimer, the term of this patent is extended or adjusted under 35 U.S.C. 154(b) by 0 days.

(21) Appl. No.: 10/138,958

(22) Filed: May 4, 2002

Related U.S. Application Data

(63) Continuation-in-part of application No. 09/605,324, filed on Jun. 28, 2000, now Pat. No. 6,383,992.

(51) Int. Cl.[7] ..... C10M 141/02; C10M 141/06

(52) U.S. Cl. ..... 508/491; 508/563

(58) Field of Search ..... 508/491, 563

(56) References Cited

U.S. PATENT DOCUMENTS

| | | | | | |
|---|---|---|---|---|---|
| 4,783,274 | A | | 11/1988 | Jokinen et al. | |
| 5,538,654 | A | | 7/1996 | Lawate et al. | |
| 5,580,482 | A | | 12/1996 | Chasen et al. | |
| 5,696,066 | A | * | 12/1997 | Kinker et al. | 508/491 |
| 5,773,391 | A | * | 6/1998 | Lawate et al. | 508/257 |
| 5,888,947 | A | | 3/1999 | Lambert et al. | |
| 5,916,854 | A | * | 6/1999 | Inaya et al. | 508/452 |
| 5,990,055 | A | * | 11/1999 | Garmier | 508/491 |
| 6,300,292 | B2 | | 10/2001 | Konishi et al. | |
| 6,312,623 | B1 | | 11/2001 | Oommen et al. | |
| 6,383,992 | B1 | * | 5/2002 | Garmier et al. | 508/491 |

* cited by examiner

*Primary Examiner*—Jacqueline V. Howard
(74) *Attorney, Agent, or Firm*—James L. Cordek

(57) ABSTRACT

A composition, comprising;

(A) at least one triglyceride oil of the formula

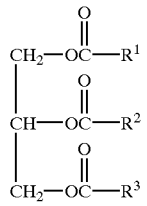

wherein $R^1$, $R^2$ and $R^3$ are aliphatic hydrocarbyl groups containing from about 7 to about 23 carbon atoms and (B) an antioxidant comprising an amine of the formula

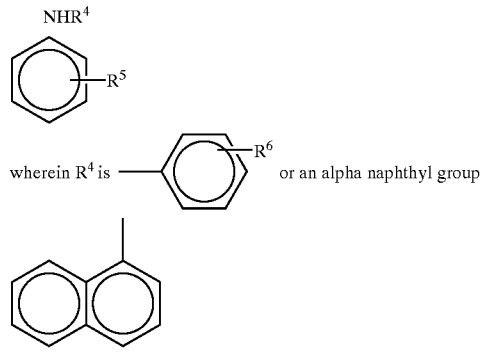

and $R^5$ is hydrogen, an alkaryl group or an aralkyl group, $R^6$ is an aryl group, an alkaryl group or an aralkyl group, with the proviso that when $R^5$ is hydrogen, then $R^4$ is an aryl group and (2) a phenol of the formula

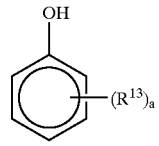

wherein $R^{13}$ is an alkyl group containing from 1 up to about 24 carbon atoms and a is an integer of from 1 up to 5.

Optionally, the (A) and (B) composition may further comprise (C) other oils.

26 Claims, No Drawings

BIODEGRADABLE VEGETABLE OIL COMPOSITIONS

This is a continuation-in-part application of Ser. No. 09/605,324 filed on Jun. 28, 2000, now U.S. Pat. No. 6,383,992.

FIELD OF THE INVENTION

This invention relates to biodegradable lubricant compositions made from vegetable oil triglycerides and antioxidants. These lubricant compositions can be used for lubricating engines, transmissions, gear boxes, and for hydraulic applications. These compositions provide antioxidant stability as well as cold temperature performance. These compositions can also be used as a base stock for biodegradable greases or any other biodegradable lubricant compositions requiring oxidation stability, such as a transformer oils, penetrating compositions, corrosion inhibition compositions and metal working compositions.

BACKGROUND OF THE INVENTION

Vegetable oils are obtainable in large volumes from renewable resources and in general are characterized as readily biodegradable or "environmentally friendly." As a result, such oils are potentially attractive for use in a wide variety of applications.

With respect to use for lubrication purposes, vegetable oils have not been fully desirable. Many vegetable oils do not possess the desired spectrum of characteristics relating to: pour point; oxidative stability; and compatibility with additives among others. Vegetable oils do however possess many desirable properties for use as a lubricant. In particular, vegetable oils typically provide good boundary lubrication, good viscosity, high viscosity index and high flash point. In addition, vegetable oils are generally nontoxic and readily biodegradable. For example, under standard test conditions (e.g., OCED 301D test method), a typical vegetable oil can biodegrade up to 80% into carbon dioxide and water in 28 days, as compared to 25% or less for typical petroleum-based lubricating fluids.

U.S. Pat. No. 4,783,274 (Jokinen et al., Nov. 8, 1988) is concerned with an anhydrous oily lubricant, which; is based on vegetable oils, which is substituted for mineral lubricant oils, and which, as its main component, contains triglycerides that are esters of saturated and/or unsaturated straight-chained $C_{10}$ to $C_{22}$ fatty acids and glycerol. The lubricant is characterized in that it contains at least 70 percent by weight of a triglyceride whose iodine number is at least 50 and no more than 125 and whose viscosity index is at least 190. As its basic component, instead of or along with the said triglyceride, the lubricant oil may also contain a polymer prepared by hot-polymerization out of the said triglyceride or out of a corresponding triglyceride. As additives, the lubricant oil may contain solvents, fatty acid derivatives, in particular their metal salts, organic or inorganic, natural or synthetic polymers, and customary additives for lubricants.

U.S. Pat. No. 5,538,654 (Lawate et al., Jul. 23, 1996) describes a food grade lubricant composition which is useful as hydraulic oil, gear oil, and compressor oil for equipment in the food service industry. This composition comprises (A) a major amount of a genetically modified vegetable oil and (B) a minor amount of a performance additive. In other embodiments the composition contains either (C) a phosphorus compound or (D) a non-genetically modified vegetable oil.

U.S. Pat. No. 5,580,482 (Chassan et al., Dec. 3, 1996) relates to a lubricant composition stabilized against the deleterious effects of heat and oxygen said composition comprising a triglyceride oil or an oil which is an ester wherein unsaturation is present in either the alcohol moiety or the acid moiety and an effective stabilizing amount of either an N,N-disubstituted aminomethyl-1,2,4-triazole or an N,N-disubstituted aminomethylbenzotriazole and a higher alkyl substituted amide of dodecylene succinic acid.

U.S. Pat. No. 5,888,947 (Lambert et al., Mar. 30, 1999 relates to a composition that has three main components: a base oil, an oil source containing hydroxy fatty acids and an oil source containing vegetable or animal waxes. The base oil used in the reference needs to consist of primarily triglycerols (triglycerides) and mono- and diglycerols (glycerides) and free fatty acids. The composition further consists of vegetable oils where the glycerols contain hydroxy fatty acids, preferably making up 5% to 20% of the oil. A third major component is waxes composing 5% to 10% of the oil additives by volume. Additional synthetic mimics or natural products derived from animal or vegetable compounds may be added up to 5% of the compositional volume.

U.S. Pat. No. 6,300,292 (Konishi et al., Oct. 9, 2001 relates to a hydraulic oil composition comprising vegetable oil with a total degree of unsaturation of 0.3 or less as base oil, and comprising at least one antioxidant selected from the group consisting of a phenol antioxidant, an amine antioxidant and a zinc dithiophosphate antioxidant in an amount of 0.01 to 5% by mass based on the total amount of the composition.

U.S. Pat. No. 6,312,623 (Oommen et al., Nov. 6, 2001) is directed to an electrical insulation fluid comprising at least 75% of a high oleic acid triglyceride composition that comprises fatty acid components of at least 75% oleic acid, less than 10% diunsaturated fatty acid component; less than 3% triunsaturated fatty acid component; and less than 8% saturated fatty acid component; and wherein said composition is further characterized by the properties of a dielectric strength of at least 35 KV/100 mil gap, a dissipation factor of less than 0.05% at 25° C., acidity of less than 0.03 mg KOH/g, electrical conductivity of less than 1 pS/m at 25° C., a flash point of at least 250° C. and a pour point of at least −15° C., and one or more additives selected from the group of an antioxidant additive, a pour point depressant additive and a copper deactivator.

SUMMARY OF THE INVENTION

A composition, comprising;

(A) at least one triglyceride oil of the formula

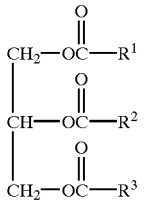

wherein $R^1$, $R^2$ and $R^3$ are aliphatic hydrocarbyl groups containing from about 7 to about 23 carbon atoms and (B) a combination of antioxidants comprising (1) two amines of the formula

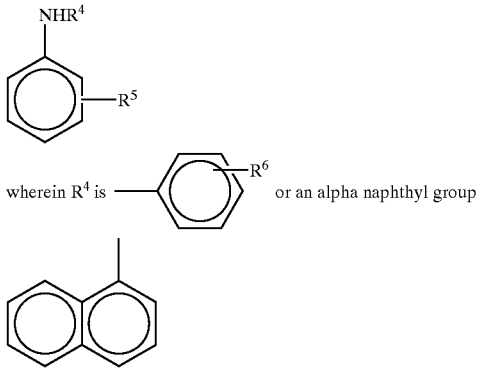

and $R^5$ is hydrogen, an alkaryl group or an aralkyl group, $R^6$ is an aryl group, an alkaryl group or an aralkyl group, with the proviso that when $R^5$ is hydrogen, then $R^4$ is an aryl group and (2) a phenol of the formula

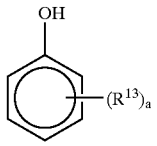

wherein $R^{13}$ is an alkyl group containing from 1 up to about 24 carbon atoms and a is an integer of from 1 up to 5.

Optionally, the (A) and (B) composition may further comprise (C) other oils comprising (1) a synthetic ester base oil, (2) a polyalphaolefin or (3) unrefined, refined or rerefined oils, and mixtures of (C) (1) to (C) (3).

DETAILED DESCRIPTION OF THE INVENTION (A) The Triglyceride Oil

In practicing this invention, the base oil is a synthetic triglyceride or a natural oil of the formula

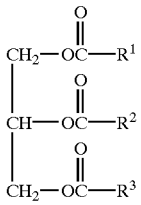

wherein $R^1$, $R^2$ and $R^3$ are aliphatic hydrocarbyl groups that contain from about 7 to about 23 carbon atoms. The term "hydrocarbyl group" as used herein denotes a radical having a carbon atom directly attached to the remainder of the molecule. The aliphatic hydrocarbyl groups include the following:

(1) Aliphatic hydrocarbon groups; that is, alkyl groups such as heptyl, nonyl, undecyl, tridecyl, heptadecyl; alkenyl groups containing a single double bond such as heptenyl, nonenyl, undecenyl, tridecenyl, heptadecenyl, heneicosenyl; alkenyl groups containing 2 or 3 double bonds such as 8,11-heptadecadienyl and 8,11,14-heptadecatrienyl. All isomers of these are included, but straight chain groups are preferred.

(2) Substituted aliphatic hydrocarbon groups; that is groups containing non-hydrocarbon substituents which, in the context of this invention, do not alter the predominantly hydrocarbon character of the group. Those skilled in the art will be aware of suitable substituents; examples are hydroxy, carbalkoxy, (especially lower carbalkoxy) and alkoxy (especially lower alkoxy), the term, "lower" denoting groups containing not more than 7 carbon atoms.

(3) Hetero groups; that is, groups which, while having predominantly aliphatic hydrocarbon character within the context of this invention, contain atoms other than carbon present in a chain or ring otherwise composed of aliphatic carbon atoms. Suitable hetero atoms will be apparent to those skilled in the art and include, for example, oxygen, nitrogen and sulfur.

The triglyceride oils suitable for use in this invention are the vegetable oils and modified vegetable oils. The vegetable oil triglycerides are naturally occurring oils. By "naturally occurring" it is meant that the seeds from which the oils are obtained have not been subjected to any genetic altering. Further, by "naturally occurring" it is meant that the oils obtained are not subjected to hydrogenation or any chemical treatment that alters the di- and tri-unsaturation character. The naturally occurring vegetable oils having utility in this invention comprise at least one of soybean oil, rapeseed oil, sunflower oil, coconut oil, lesquerella oil, canola oil, peanut oil, corn oil, cottonseed oil, palm oil, safflower oil, meadowfoam oil or castor oil.

The triglyceride oils may also be modified vegetable oils. Triglyceride oils are modified either chemically or genetically. Hydrogenation of naturally occurring triglycerides is the primary means of chemical modification. Naturally occurring triglyceride oils have varying fatty acid profiles. The fatty acid profile for naturally occurring sunflower oil is

| | |
|---|---|
| palmitic acid | 70 percent |
| stearic acid | 4.5 percent |
| oleic acid | 18.7 percent |
| linoleic acid | 67.5 percent |
| linolenic acid | 0.8 percent |
| other acids | 1.5 percent |

By chemically modifying sunflower oil by hydrogenation, it is meant that hydrogen is permitted to react with the unsaturated fatty acid profile present such as oleic acid, linoleic acid and linolenic acid. The object is not to remove all the unsaturation. Further, the object is not to hydrogenate such that the oleic acid profile is reduced to a stearic acid profile. The object of chemical modification via hydrogenation is to engage the linoleic acid profile and reduce or convert a substantial portion of it to an oleic acid profile. The linoleic acid profile of naturally occurring sunflower oil is 67.5 percent. It is a goal of chemical modification to hydrogenate such that the linoleic acid is reduced to about 25 percent. That means that the oleic acid profile is increased from 18.7 percent to about 61 percent (18.7 percent original oleic acid profile plus 42.5 percent generated oleic acid from linoleic acid).

Hydrogenation is the reaction of a vegetable oil with hydrogen gas in the presence of a catalyst. The most commonly used catalyst is a nickel catalyst. This treatment results in the addition of hydrogen to the oil, thus reducing the linoleic acid profile and linolenic acid profile. Only the unsaturated fatty acid profiles participate in the hydrogenation reaction. During hydrogenation, other reactions also occur, such as shifting of the double bonds to a new position and also twisting from the cis form to the higher melting trans form.

Table I shows the oleic acid (18:1), linoleic acid (18:2) and linolenic acid (18:3) profiles of selected naturally occurring vegetable oils. It is possible to chemically modify, via hydrogenation, a substantial portion of the linoleic acid profile of the trilyceride to increase the oleic acid profile to above 60 percent.

TABLE I

| Oil | 18:1 | 18:2 | 18:3 |
|---|---|---|---|
| Corn oil | 25.4 | 59.6 | 1.2 |
| Cottonseed oil | 18.6 | 54.4 | 0.7 |
| Peanut oil | 46.7 | 32.0 | — |
| Safflower oil | 12.0 | 77.7 | 0.4 |
| Soybean oil | 23.2 | 53.7 | 7.6 |
| Sunflower oil | 18.7 | 67.5 | 0.8 |

Genetic modification occurs in the seed stock. The harvested crop then contains a triglyceride oil that when extracted has a much higher oleic acid profile and a much lower linoleic acid profile. Referring to Table I above, a naturally occurring sunflower oil has an oleic acid profile of 18.7 percent. A genetically modified sunflower oil has an oleic acid profile of 81.3 percent and linoleic acid profile of 9.0 percent. One can also genetically modify the various vegetable oils from Table I to obtain an oleic acid profile of above 90 percent. The chemically modified vegetable oils comprise at least one of a chemically modified corn oil, chemically modified cottonseed oil, chemically modified peanut oil, chemically modified palm oil, chemically modified castor oil, chemically modified canola oil, chemically modified rapeseed oil, chemically modified safflower oil, chemically modified soybean oil and chemically modified sunflower oil.

In a preferred embodiment, the aliphatic hydrocarbyl groups of $R^1$, $R^2$ and $R^3$ are such that the triglyceride has a monounsaturated character of at least 60 percent, preferably at least 70 percent and most preferably at least 80 percent. Triglycerides having utility in this invention are exemplified by vegetable oils that are genetically modified such that they contain a higher than normal oleic acid content. Normal sunflower oil has an oleic acid content of 25–30 percent. By genetically modifying the seeds of sunflowers, a sunflower oil can be obtained wherein the oleic content is from about 60 percent up to about 90 percent. That is, the $R^1$, $R^2$ and $R^3$ groups are heptadecenyl groups and the $R^1COO$—, $R^2COO$— and $R^3COO$— to the 1,2,3-propanetriyl group $CH_2CHCH_2$ are the residue of an oleic acid molecule. U.S. Pat. No. 4,627,192 and U.S. Pat. No. 4,743,402 are herein incorporated by reference for their disclosure to the preparation of high oleic sunflower oil.

For example, a triglyceride comprised exclusively of an oleic acid moiety has an oleic acid content of 100% and consequently a monounsaturated content of 100%. Where the triglyceride is made up of acid moieties that are 70% oleic acid, 10% stearic acid, 13% palmitic acid, and 7% linoleic acid, the monounsaturated content is 70%. The preferred triglyceride oils are high oleic acid, that is, genetically modified vegetable oils (at least 60 percent) triglyceride oils. Typical high oleic vegetable oils employed within the instant invention are high oleic safflower oil, high oleic canola oil, high oleic peanut oil, high oleic corn oil, high oleic rapeseed oil, high oleic sunflower oil, high oleic cottonseed, high oleic lesquerella oil, high oleic palm oil, high oleic castor oil, high oleic meadowfoam oil and high oleic soybean oil. Canola oil is a variety of rapeseed oil containing less than 1 percent erucic acid. A preferred high oleic vegetable oil is high oleic sunflower oil obtained from Helianthus sp. This product is available from AC Humko, Cordova, Tenn., 38018 as TriSun™ high oleic sunflower oil. TriSun 80 is a high oleic triglyceride wherein the acid moieties comprise 80 percent oleic acid. Another preferred high oleic vegetable oil is high oleic canola oil obtained from *Brassica campestris* or *Brassica napus*, also available from AC Humko as RS high oleic oil. RS80 oil signifies a canola oil wherein the acid moieties comprise 80 percent oleic acid.

It is further to be noted that genetically modified vegetable oils have high oleic acid contents at the expense of the di-and tri- unsaturated acids. A normal sunflower oil has from 20–40 percent oleic acid moieties and from 50–70 percent linoleic acid moieties. This gives a 90 percent content of mono- and di- unsaturated acid moieties (20+70) or (40+50). Genetically modifying vegetable oils generate a low di- or tri- unsaturated moiety vegetable oil. The genetically modified oils of this invention have an oleic acid moiety:linoleic acid moiety ratio of from about 2 up to about 90. A 60 percent oleic acid moiety content and 30 percent linoleic acid moiety content of a triglyceride oil gives a ratio of 2. A triglyceride oil made up of an 80 percent oleic acid moiety and 10 percent linoleic acid moiety gives a ratio of 8. A triglyceride oil made up of a 90 percent oleic acid moiety and 1 percent linoleic acid moiety gives a ratio of 90. The ratio for normal sunflower oil is 0.5 (30 percent oleic acid moiety and 60 percent linoleic acid moiety).

(B) The Antioxidants

Antioxidants having utility in this invention are a combination of two amine antioxidants and a phenolic antioxidant.

The amine antioxidant is of the formula

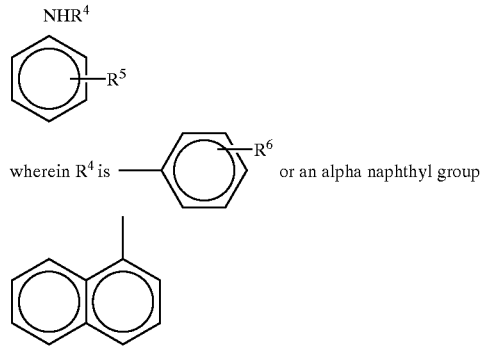

and $R^5$ is hydrogen, an alkaryl group or an aralkyl group, $R^6$ is an aryl group, an alkaryl group or an aralkyl group, with the proviso that when $R^5$ is hydrogen, then $R^4$ is an aryl group.

Within the amine antioxidant, when $R^4$ is

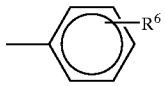

preferably $R^5$ and $R^6$ are alkaryl groups represented by the structure

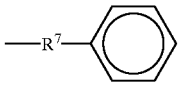

and $R^7$ is an aliphatic group that contains from 1 to 4 carbon atoms.

Preferably $R^7$ contains 2 carbon atoms and is represented by the structure

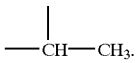

One preferred amine antioxidant is styrenated diphenylamine of the formula

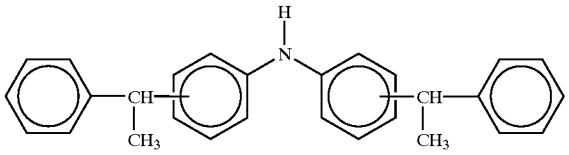

available as Wingstay® 29 from Goodyear in Akron, Ohio 44316.

In another amine antioxidant used with the above described Wingstay 29, $R^5$ is hydrogen and $R^4$ is an alpha naphthyl group group is of the structure

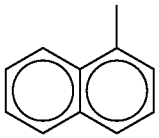

and this preferred amine antioxidant has the formula

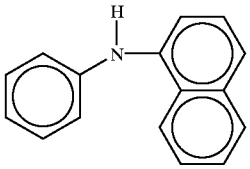

which is phenyl-α-naphthylamine (PANA).

The phenol as an antioxidant is an alkyl phenol of the formula

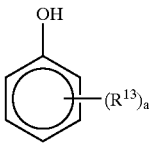

wherein $R^{13}$ is an alkyl group containing from 1 up to about 24 carbon atoms and a is an integer of from 1 up to 5. Preferably $R^{13}$ contains from 4 to 18 carbon atoms and most preferably from 4 to 12 carbon atoms. $R^{13}$ may be either straight chained or branched chained and branched chained is preferred. The preferred value for a is an integer of from 1 to 4 and most preferred is from 1 to 3. An especially preferred value for a is 2. When a is not 5, it is preferred that the position para to the OH group be open.

Mixtures of alkyl phenols may be employed. Preferably the phenol is a butyl substituted phenol containing 2 or 3 t-butyl groups. When a is 2, the t-butyl groups occupy the 2, 6-position and the preferred phenol is 2,6-di-t-butylphenol, wherein the phenol is sterically hindered:

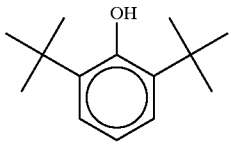

(C) The Other Oils

The (A) and (B) composition of this invention may further comprise other oils comprising (C) (1) a synthetic ester base oil, (C) (2) a polyalphaolefin or (C) (3) unrefined, refined or rerefined oils as well as mixtures of two or more of any of (C) (1), (C) (2) and (C) (3). The synthetic ester base oil (C) (1) comprises the reaction of a monocarboxylic acid of the formula $$R^8COOH,$$

a dicarboxylic acid of the formula

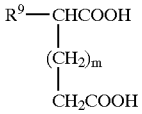

or an aryl carboxylic acid of the formula $$R^{10}—Ar(COOH)_p$$

wherein $R^8$ is a hydrocarbyl group containing from about 4 to about 24 carbon atoms, $R^9$ is hydrogen or a hydrocarbyl group containing from about 4 to about 50 carbon atoms, $R^{10}$ is hydrogen or a hydrocarbyl group containing from 1 up to about 24 carbon atoms, m is an integer of from zero to about 6 and p is an integer of from 1 to about 4; with an alcohol of the formula

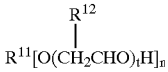

wherein $R^{11}$ is an aliphatic group containing from 1 to about 24 carbon atoms or an aromatic group containing from 6 to about 18 carbon atoms, $R^{12}$ is hydrogen or an alkyl group containing 1 or 2 carbon atoms, t is from 0 to about 40 and n is from 1 to about 6.

Within the monocarboxylic acid, $R^8$ preferably contains from about 6 to about 18 carbon atoms. An illustrative but non-exhaustive list of monocarboxylic acids are the carboxylic acids of butanoic acid, hexanoic acid, octanoic acid, nonanoic acid, decanoic acid, undecanoic acid, dodecanoic acid, palmitic acid, stearic acid and oleic acid, as well as isomers of these acids and mixtures thereof.

Within the dicarboxylic acid, $R^9$ preferably contains from about 4 to about 24 carbon atoms and m is an integer of from 1 to about 3. An illustrative but non-exhaustive list of dicarboxylic acids are succinic, glutaric, adipic, pimelic, suberic, azelaic, sebacic, maleic, and fumaric acids.

As aryl carboxylic acids, $R^{10}$ preferably contains from about 6 to about 18 carbon atoms and p is 2. Aryl carboxylic acids having utility are benzoic, toluic, ethylbenzoic, phthalic, isophthalic, terephthalic, hemimellitic, trimellitic, trimeric, and pyromellitic acids.

Within the alcohols, $R^{11}$ preferably contains from about 3 to about 18 carbon atoms and t is from 0 to about 20. The alcohols may be monohydric, polyhydric or alkoxylated monohydric and polyhydric. Monohydric alcohols can comprise, for example, primary and secondary alcohols. The preferred monohydric alcohols, however are primary aliphatic alcohols, especially aliphatic hydrocarbon alcohols such as alkenols and alkanols. Examples of the preferred monohydric alcohols from which $R^{11}$ is derived include 1-octanol, 1-decanol, 1-dodecanol, 1-tetradecanol, 1-hexadecanol, 1-octadecanol, oleyl alcohol, linoleyl alcohol, linolenyl alcohol, phytol, myristyl alcohol lauryl alcohol, myristyl alcohol, cetyl alcohol, stearyl alcohol, and behenyl alcohol.

Examples of polyhydric alcohols are those containing from 2 to about 6 hydroxy groups. They are illustrated, for example, by the alkylene glycols such as ethylene glycol, diethylene glycol, triethylene glycol, tetraethylene glycol, dipropylene glycol, tripropylene glycol, dibutylene glycol, tributylene glycol, and other alkylene glycols. A preferred class of alcohols suitable for use in this invention are those polyhydric alcohols containing up to about 12 carbon atoms. This class of alcohols includes glycerol, erythritol, pentaerythritol, dipentaerythritol, gluconic acid, glyceraldehyde, glucose, arabinose, 1,7-heptanediol, 2,4-heptanediol, 1,2,3-hexanetriol, 1,2,4-hexanetriol, 1,2,5-hexanetriol, 2,3,4-hexanetriol, 1,2,3-butanetriol, 1,2,4-butanetriol, quinic acid, 2,2,6,6-tetrakis (hydroxymethyl) cyclohexanol, 1–10-decanediol, digitaloal, and the like.

Another preferred class of polyhydric alcohols for use in this invention are the polyhydric alcohols containing 3 to 10 carbon atoms and particularly those containing 3 to 6 carbon atoms and having at least three hydroxyl groups. Such alcohols are exemplified by a glycerol, erythritol, pentaerythritol, mannitol, sorbitol, 2-hydroxymethyl-2-methyl-1,3,propanediol(trimethylolpropane), bis-trimethylolpropane, 1,2,4-hexanetriol and the like.

The alkoxylated alcohols may be alkoxylated monohydric alcohols or alkoxylated polyhydric alcohols. The alkoxy alcohols are generally produced by treating an alcohol with an excess of an alkylene oxide such as ethylene oxide or propylene oxide. For example, from about 6 to about 40 moles of ethylene oxide or propylene oxide may be condensed with an aliphatic alcohol.

In one embodiment, the aliphatic alcohol contains from about 14 to about 24 carbon atoms and may be derived from long chain fatty alcohols such as stearyl alcohol or oleyl alcohol.

The alkoxy alcohols useful in the reaction with the carboxylic acids to prepare synthetic esters are available commercially under such trade names as "TRITON®", "TERGITOL®" from Union Carbide, "ALFONIC®" from Vista Chemical, and "NEODOL®" from Shell Chemical Company. The TRITON® materials are identified generally as polyethoxylated alkyl phenols which may be derived from straight chain or branched chain alkyl phenols. The TERGITOLS® are identified as polyethylene glycol ethers of primary or secondary alcohols; the ALFONIC® materials are identified as ethyoxylated linear alcohols which may be represented by the general structure formula $$CH_3(CH_2)_xCH_2(OCH_2CH_2)_nOH$$

wherein x varies between 4 and 16 and n is a number between about 3 and 11. Specific examples of ALFONIC® ethoxylates characterized by the above formula include ALFONIC® 1012-60 wherein x is about 8 to 10 and n is an average of about 5.7; ALFONIC® 1214-70 wherein x is about 10–12 and n is an average of about 10.6; ALFONIC® 1412-60 wherein x is from 10–12 and n is an average of about 7; and ALFONIC® 1218-70 wherein x is about 10–16 and n is an average of about 10.7.

The NEODOL® ethoxylates are ethoxylated alcohols wherein the alcohols are a mixture of linear and branched alcohols containing from 9 to about 15 carbon atoms. The ethoxylates are obtained by reacting the alcohols with an excess of ethylene oxide such as from about 3 to about 12 or more moles of ethylene oxide per mole of alcohol. For example, NEODOL® ethoxylate 23-6.5 is a mixed linear and branched chain alcoholate of 12 to 13 carbon atoms with an average of about 6.5 ethoxy units.

As stated above, the synthetic ester base oil comprises reacting any above-identified acid or mixtures thereof with any above-identified alcohol or mixtures thereof at a ratio of not more than 1 COOH per 1 OH group using esterification procedures, conditions and catalysts known in the art.

In some instances, not all the OH groups are reacted with the COOH groups. Examples of these synthetic ester base oils are glycerol mono-oleate and glycerol di-oleate whose reactions respectively, appear below.

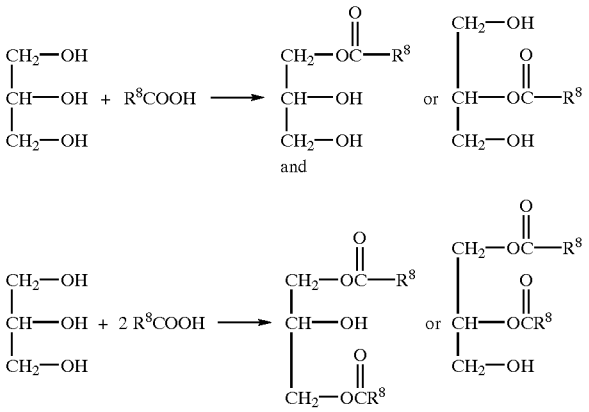

When glycerol mono-oleate and glycerol di-oleate are used as (C) (1), it is common for a mixture of isomers of gylcerol mono-oleate to be present and also for a mixture of isomers of gylcerol di-oleate to be present.

A non-exhaustive list of companies that produce synthetic esters and their trade names are BASF as Glissofluid, Ciba-Geigy as Reolube, JCI as Emkarote, Oleofina as Radialube and the Emery Group of Henkel Corporation as Emery.

The polyalphaolefins (C) (2) such as alkylene oxide polymers and interpolymers and derivative thereof where the terminal hydroxyl groups have been modified by esterification, etherification, etc., constitute another class of oils that can be used. These are exemplified by the oils prepared through polymerization of ethylene oxide or propylene oxide, the alkyl and aryl ethers of these polyoxyalkylene polymers (e.g., methylpolyisopropylene glycolether having an average molecule weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_3$–$C_8$ fatty acid esters, or the $C_3$ Oxo acid diester of tetraethyleneglycol.

The unrefined, refined and rerefined oils, (C) (3), as well as mixtures of two or more of any of these can be used in the lubricant composition of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Within the context of this invention, mineral oils are under the purview of petroleum oils. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

The compositions of the present invention comprising components (A) and (B) or (A), (B) and (C) are useful as biodegradable lubricants.

When the composition comprises components (A) and (B), the following states the ranges of these components in parts by weight.

| Component | Generally | Preferred | Most Preferred |
|---|---|---|---|
| (A) | 50–99.9 | 65–99.9 | 98.8–99.9 |
| (B) | 0.1–50 | 0.1–35 | 0.1–1.2 |

When the composition comprises components (A), (B), (C) and (D), the following states the ranges of these components in parts by weight.

| Component | Generally | Preferred | Most Preferred |
|---|---|---|---|
| (A) | 40–90 | 40–80 | 45–75 |
| (B) | 0.1–5 | 0.1–3 | 0.1–2 |
| (C) | 1–80 | 10–60 | 25–50 |

It is also to be recognized that concentrates of the invention can be formed. The concentrates comprise a minor amount of (A) with a major amount of (B), a minor amount of (A) and a major amount of the combination of (B) and (C) or a minor amount of the combination of (A) and (C) with a major amount of (B).

The term "minor amount" as used in the description and appended claims is intended to mean that when a composition contains a "minor amount" of a specific material that amount is less than 50 percent by weight of the composition.

The term "major amount" as used in the description and appended claims is intended to mean that when a composition contains a "major amount" of a specific material that amount is more than 50 percent by weight of the composition. It is understood that other components besides (A), (B) and (C) may be present within the composition of this invention.

The components of this invention are blended together according to the above ranges to effect solution. Order of addition is of no consequence, although typically (B) and (C) are added to (A).

The inventors have found an unexpected synergism to occur when utilizing the two amine antioxidants (B)(1) and the phenolic antioxidant (B)(2). The data in Table II shows a synergism of (B)(1) and (B)(2) that allows oxidation protection at a lower usage or treat rate than can be obtained at a higher concentration of each antioxidant alone, or of just two antioxidants.

Vegetable oils do not have natural antioxidation properties as do mineral oils. Thus formulations that contain vegetable oils must also contain antioxidants The vegetable oil formulations of this invention are evaluated in the rotary bomb oxidation test (RBOT) and the results are shown in Table II. In Table II, Examples 1 and 2 are baselines of 100 percent vegetable oils. The remaining examples contain other additives in varying amounts. Example 5 is 100 percent mineral oil (compare to Examples 1 and 2). Example 3 only contains 2,6-di-t-butlylphenol (DTBP) as an antioxidant in vegetable oil and it is compared to Example 10 of DTBP in mineral oil. Note how much less DTBP is used in Example 10 and yet the RBOT value of Example 10, (mineral oil formulation) is much higher than that of Example 3 (vegetable oil formulation). Examples 1, 2, 3, 5 and 10 show the low RBOT values of vegetable oil formulations in comparison to mineral oil formulations. All parts are by weight.

Example 6 and 9 are directed to the instant invention in that (A) is a vegetable oil and (B) contains two antioxidants of (B)(1): Wingstay 29 and PANA and the one antioxidant of (B)(2): DTBP. The RBOT values of Examples 6 and 9 are 402 and 267, respectfully.

The remaining vegetable oil formulations do not contain the two antioxidants of (B)(1) with the one antioxidant of (B)(2). Consequently none of the remaining formulations have RBOT values that even approach those of Examples 6 and 9. Example 4 is a vegetable oil formulation that contains an ashless phenolic antioxidant which is a mixture of butylated phenols. Example 7 is a vegetable oil formulation that contains LZ 5186B. The LZ 5186B contributes 0.36 parts of DTBP. Example 8 is a vegetable oil and synthetic ester formulation that contains LZ 7653. The LZ 7653 contributes 0.6 parts DTBP. Example 11 is a vegetable oil formulation that contains RC 9308. The RC 9308 contributes 0.03 parts of an alkylated amine, 0.2 parts of an aromatic amine and 0.55 parts of butylated hydroxytoluene. Even though RC 9308 is a mixture of antioxidants, the RBOT value is only 97. Example 12 is a vegetable oil formulation that contains an alkylated diphenylamine, butylated hydroxytoluene and a phosphorus/sulfur additive. The alkylated diphenylamine is one of the amines of instant (B)(1). Example 13 is a vegetable oil formulation that contains an alkylated diphenylamine and butylated hydroxytoluene. A very low RBOT value is obtained. Example 14 is a vegetable oil formulation that contains a dithiocarbamate, tolutriazole and DTBP. Example 15 is a vegetable oil formulation that contains the ashless phenolic antioxidant of Example 4, discussed above, and butylated hydroxytoluene. Example 17 is a vegetable oil formulation that contains tolutriazole and a phenolic antioxidant identified as Irganox L135. Example 19 is a vegetable oil formulation that contains the additives of Example 17 and also contains DTBP. Example 20 is a vegetable oil formulation that contains tolutriazole, the butylated reaction product of p-cresol and dicyclopentadiene and also DTBP. Example 21 is a vegetable oil formulation that contains the ashless phenolic antioxidant of Example 4 and DTBP. Example 16 is a vegetable oil formulation that contains the dithiocarbamate and tolutriazole of Example 14 and the phosphorus/sulfur additive of Example 12. Example 18 is a vegetable oil formulation that contains the dithiocarbamate and tolutriazole of Example 14

TABLE II

| EXAMPLE | COMPONENTS (A) | (B) | (C) | Other Additives | RBOT |
|---|---|---|---|---|---|
| 1. | 100 Parts TriSun 90 | None | None | None | 16 |
| 2. | 100 parts RS 80 | None | None | None | 14 |
| 3. | 98.0 parts TriSun 90 | 2 parts DTBP | None | None | 131 |
| 4. | 98.0 parts TriSun 90 | None | None | 2.0 parts (a) | 138 |
| 5. | 100 parts mineral oil | None | None | None | 30 |
| 6. | 67.08 parts TriSun 90 | 0.2 parts Wingstay 29<br>0.2 parts PANA<br>0.36 parts DTBP | 15.25 parts PAO<br>15.25 parts syn ester | 2.03 parts pour point depressant | 402 |
| 7. | 98.75 parts TriSun 90 | 0.36 parts DTBP (b) | None | None | 147 |
| 8. | 67.2 parts TriSun 90 | None | 28.8 parts syn ester | 4.0 parts (c) | 197 |
| 9. | 98.27 parts TriSun 90 | 0.15 parts Wingstay 29<br>0.15 parts PANA<br>0.4 parts DTBP | None | None | 267 |
| 10. | 98.75 parts mineral oil | 0.36 parts DTBP | None | None | 262 |
| 11. | 99 parts TriSun 90 | | None | 1.0 part (d) | 97 |
| 12. | 98.15 parts TriSun 90 | None | None | 0.65 parts (e), 0.35 parts (f), 0.85 parts (g) | 104 |
| 13. | 97.8 parts TriSun 90 | None | None | 1.4 parts (e),, 0.8 parts (f) | 61 |
| 14. | 98.15 parts TriSun 90 | 0.36 parts DTBP | None | 0.2 parts (h), 0.4 parts (i) | 94 |
| 15. | 98.0 parts TriSun 90 | None | None | 1.0 part (a), 1.0 part (f) | 110 |
| 16. | 98.55 parts TriSun 90 | None | None | 0.2 parts (h) 0.4 parts (i) 0.85 parts (g) | 142 |
| 17. | 98.6 parts TriSun 90 | None | None | 0.5 parts (i), 0.9 parts (j) | 108 |
| 18. | 98.65 parts TriSun 90 | None | None | 0.45 parts (h), 0.9 parts (i) | 197 |
| 19. | 98.15 parts TriSun 90 | 0.36 parts DTBP | None | 0.3 parts (i), 0.3 parts (j) | 149 |
| 20. | 98.15 parts TriSun 90 | 0.36 parts DTBP | None | 0.3 parts (i), 0.3 parts (k) | 128 |
| 21. | 98.0 parts TriSun 90 | 1.0 parts DTBP | None | 1.0 parts (b) | 156 |

(a): an ashless phenolic antioxidant available from Ethyl as Hitec 4733, a mixture of butylated phenols (b): a complete hydraulic package that contains antiwear agents and antioxidants available from The Lubrizol Corp as LZ 5186B, which contributes approximately 0.36 parts DTBP (c): a complete commercial hydraulic package used for high oleic vegetable oils and synthetic esters that contains antiwear, antioxidants and pour point depressants available from The Lubrizol Corp as LZ 7653

(d): a commercial rust and antioxidant composition available from Rhein Chemie as Additin ® RC 9308, one part of which contributes approximately 0.03 parts alkyl amine, 0.12 parts aromatic amine and 0.55 parts butylated hydroxytoluene (e): an alkylated diphenylamine, available from RT Vanderbilt as Vanlube NA (f): butylated hydroxytoluene, available from RT Vanderbilt as Vanlube PCX (g): an antiwear/antioxidant of an organic chemical additive containing phosphorus and sulfur, available from RT Vanderbilt as Vanlube 727

(h): a dithiocarbamate antioxidant available from RT Vanderbilt as Vanlube 7723

(i): tolutriazole antioxidant available from RT Vanderbilt as Vanlube 887

(j): liquid phenolic antioxidant available from Ciba Geigy as Irganox L 135

(k): butylated reaction product of p-cresol and dicyclopentadiene, available from Goodyear as Wingstay L-HLS While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A composition, comprising;

(A) at least one triglyceride oil of the formula

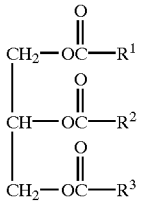

wherein $R^1$, $R^2$ and $R^3$ are aliphatic hydrocarbyl groups containing from about 7 to about 23 carbon atoms and (B) a combination of antioxidants comprising (1) two amines of the formula

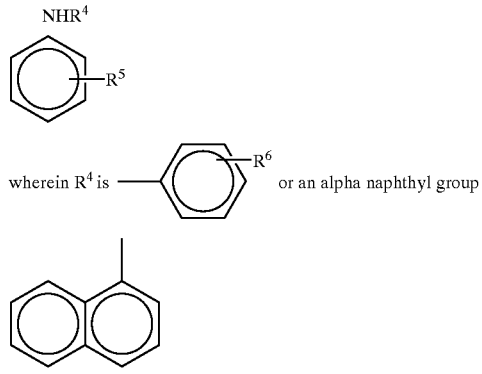

and $R^5$ is hydrogen, an alkaryl group or an aralkyl group, $R^6$ is an aryl group, an alkaryl group or an aralkyl group, with the proviso that when $R^5$ is hydrogen, then $R^4$ is an aryl group and (2) a phenol of the formula

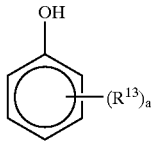

wherein $R^{13}$ is an alkyl group containing from 1 up to about 24 carbon atoms and a is an integer of from 1 up to 5.

2. The composition of claim 1 wherein within (A), the triglyceride oil is a naturally occurring vegetable oil.

3. The composition of claim 1 wherein within (A), the triglyceride oil is a modified vegetable oil.

4. The composition of claim 2 wherein the naturally occurring vegetable oil comprises at least one of soybean oil, rapeseed oil, sunflower oil, coconut oil, lesquerella oil, canola oil, peanut oil, corn oil, cottonseed oil, palm oil, safflower oil, meadowfoam oil or castor oil.

5. The composition of claim 3 wherein the modified vegetable oil is a chemically modified vegetable oil or a genetically modified vegetable oil.

6. The composition of claim 5 wherein $R^1$, $R^2$ and $R^3$ have at least a 60 percent monounsaturation content derived from an oleic acid residue.

7. The composition of claim 6 wherein the chemically modified vegetable oil comprises at least one of a chemically modified corn oil, chemically modified cottonseed oil, chemically modified peanut oil, chemically modified palm oil, chemically modified castor oil, chemically modified canola oil, chemically modified rapeseed oil, chemically modified safflower oil, chemically modified soybean oil and chemically modified sunflower oil.

8. The composition of claim 6 wherein the genetically modified vegetable oil comprises at least one of a genetically modified safflower oil, genetically modified canola oil, genetically modified peanut oil, genetically modified corn oil, genetically modified rapeseed oil, genetically modified sunflower oil, genetically modified cottonseed, genetically modified lesquerella oil, genetically modified palm oil, genetically modified castor oil, genetically modified meadowfoam oil or genetically modified soybean oil.

9. The composition of claim 1 wherein within (B) (1), $R^5$ and $R^6$ are alkaryl groups wherein the alkaryl group is

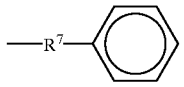

and $R^7$ is an aliphatic group that contains from 1 to 4 carbon atoms.

10. The composition of claim 9 wherein $R^7$ contains 2 carbon atoms.

11. The composition of claim 9 wherein $R^7$ is

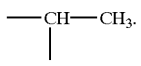

12. The composition of claim 1 wherein within (B) (1), $R^5$ is hydrogen and $R^4$ is an alpha naphthyl group.

13. The composition of claim 1 wherein within (B) (2), a is 2 and $R^{13}$ contains from 1 up to 8 carbon atoms.

14. The composition of claim 13 wherein the alkyl phenol is of the formula

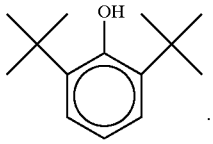

15. The composition of claim 1 further comprising (C) other oils comprising (1) a synthetic ester base oil (2) a polyalphaolefin or (3) unrefined, refined or rerefined oils or mixtures of two or more of any of (C) (1), (C) (2) and (C) (3).

16. The composition of claim 15 wherein the synthetic ester base oil comprises the reaction of a monocarboxylic acid of the formula $$R^8COOH$$

or a dicarboxylic acid of the formula $$R^9—\underset{\underset{CH_2COOH}{|}}{\underset{\underset{(CH_2)_m}{|}}{CHCOOH}}$$

or an aryl carboxylic acid of the formula $$R^{10}—Ar(COOH)_p$$

wherein $R^8$ is a hydrocarbyl group containing from about 4 to about 24 carbon atoms, $R^9$ is hydrogen or a hydrocarbyl group containing from about 4 to about 50 carbon atoms, $R^{10}$ is hydrogen or a hydrocarbyl group containing from 1 up to about 24 carbon atoms, m is an integer of from zero to about 6 and p is an integer of from 1 to about 4; with an alcohol of the formula $$R^{11}[O(\overset{\overset{R^{12}}{|}}{CH_2CHO})_tH]_n$$

wherein $R^{11}$ is an aliphatic group containing from 1 to about 24 carbon atoms or an aromatic group containing from 6 to about 18 carbon atoms, $R^{12}$ is hydrogen or an alkyl group containing 1 or 2 carbon atoms, t is from 0 to about 40 and n is from 1 to about 6.

17. The composition of claim 16 wherein $R^8$ contains from about 6 to about 18 carbon atoms.

18. The composition of claim 16 wherein $R^9$ contains from about 4 to about 24 carbon atoms and m is zero.

19. The composition of claim 16 wherein $R^9$ is hydrogen and m is 4.

20. The composition of claim 16 wherein $R^{10}$ contains from about 6 to about 18 carbon atoms and p is 2.

21. The composition of claim 16 wherein $R^{11}$ contains from about 3 to about 18 carbon atoms.

22. The composition of claim 16 wherein the alcohol is glycerol and $R^8COOH$ is oleic acid wherein the molar ratio of glycerol:oleic acid is 1:1.

23. The composition of claim 16 wherein the alcohol is glycerol and $R^8COOH$ is oleic acid wherein the molar ratio of glycerol:oleic acid is 1:2.

24. A concentrate of claim 1 which comprises a minor amount of (A) and a major amount of (B).

25. A concentrate of claim 15 which comprises a minor amount of (A) and a major amount of (B) and (C).

26. A concentrate of claim 15 which comprises a minor amount of (A) and (C) and a major amount of (B).

* * * * *